US012214949B2

(12) United States Patent
Tamarindo et al.

(10) Patent No.: US 12,214,949 B2
(45) Date of Patent: Feb. 4, 2025

(54) CLOSURE FOR A THIN-WALLED PACKAGING PROVIDED WITH A SPOUT

(71) Applicant: GUALA PACK S.P.A., Castellazzo Bormida (IT)

(72) Inventors: Stefano Tamarindo, Castellazzo Bormida (IT); Alberto Buzzi, Castellazzo Bormida (IT)

(73) Assignee: GUALA PACK S.P.A., Castellazzo Bormida (IT)

( * ) Notice: Subject to any disclaimer, the term of this patent is extended or adjusted under 35 U.S.C. 154(b) by 229 days.

(21) Appl. No.: 18/003,726

(22) PCT Filed: Jun. 11, 2021

(86) PCT No.: PCT/IB2021/055160
§ 371 (c)(1),
(2) Date: Dec. 29, 2022

(87) PCT Pub. No.: WO2022/018536
PCT Pub. Date: Jan. 27, 2022

(65) Prior Publication Data

US 2023/0257180 A1 Aug. 17, 2023

(30) Foreign Application Priority Data

Jul. 24, 2020 (IT) ..... 102020000017998

(51) Int. Cl.
*B65D 75/58* (2006.01)
*B65D 55/02* (2006.01)

(52) U.S. Cl.
CPC ..... *B65D 75/5883* (2013.01); *B65D 55/026* (2013.01)

(58) Field of Classification Search
CPC ..... B65D 75/5883; B65D 55/026
USPC ..... 222/92
See application file for complete search history.

(56) References Cited

U.S. PATENT DOCUMENTS

| | | | |
|---|---|---|---|
| 2002/0175137 | A1 | 11/2002 | Rousselet |
| 2016/0130049 | A1 | 5/2016 | Rogers et al. |
| 2017/0073130 | A1 | 3/2017 | Giraud et al. |

FOREIGN PATENT DOCUMENTS

| | | | |
|---|---|---|---|
| EP | 1247749 | A2 | 10/2002 |
| IT | 102020000008638 | A | 4/2021 |
| WO | 2007134756 | A1 | 11/2007 |
| WO | 2020089721 | A1 | 5/2020 |
| WO | 2020111939 | A1 | 6/2020 |
| WO | 2020161633 | A1 | 8/2020 |
| WO | 2020240294 | A1 | 12/2020 |

OTHER PUBLICATIONS

International Search Report and Written Opinion for International Patent Application No. PCT/IB2021/055160, mailed Oct. 7, 2021, 11 pages.

*Primary Examiner* — Paul R Durand
*Assistant Examiner* — Michael J. Melaragno
(74) *Attorney, Agent, or Firm* — Armstrong Teasdale LLP

(57) ABSTRACT

A closure for a spout of a flexible thin-walled packaging is provided. The closure has a base body having an irreversibly yielding guarantee wall, a cap assembly having a cap and a guarantee tab, at least one breakable bridge, and a flexible hinge that joins the base body to the cap assembly. The at least one breakable bridge, in an intact closed configuration, is integral and joins the guarantee tab to the guarantee wall.

10 Claims, 6 Drawing Sheets

CLOSURE FOR A THIN-WALLED PACKAGING PROVIDED WITH A SPOUT

CROSS-REFERENCE TO RELATED APPLICATION

This application is a National Stage Application of International Patent Application No. PCT/IB2021/055160, having an International Filing Date of Jun. 11, 2021, which claims priority to Italian Application No. 102020000017998, filed Jul. 24, 2020, the entire contents of each of which are hereby incorporated by reference herein.

FIELD OF THE INVENTION

This invention relates to the field of thin-walled packagings provided with a spout, generally known as spouted pouches, which are normally used for containing food products such as yogurts, purees and fruit juices, energy drinks and the like. In particular, this packaging is widely used for containing drinks for children.

BACKGROUND OF THE INVENTION

The closure of the flexible pouch usually consists of a cap which may be screwed to the spout and is provided with a guarantee seal; when the cap is unscrewed, the guarantee seal breaks, thereby showing that it is used, and the cap is separated from the spout.

Thanks to the ease of use and the playful aspect linked to the spout, this packaging, the components of which are made from plastics material, has become hugely widespread. Several hundred million units are produced and sold every year. As consumers become increasingly aware of environmental protection issues, manufacturers are motivated to search for solutions which are able to minimize environmental impact.

For example, in this specific sector, efforts are concentrated on searching for a solution for a closure provided with a guarantee seal, the cap of which closure, after being unscrewed, is not separated from the spout, so as to prevent the spout from being lost in the environment separately from the pouch.

In this respect, the Applicant is the proprietor of international applications WO-A1-2020/089721, PCT/IB2020/050910 and PCT/IB2020/053803 and the Italian patent application for invention no. 10 2020 000 008 638.

SUMMARY OF THE INVENTION

The object of this invention is to provide a further closure for a spout of a thin-walled packaging, for which the cap does not separate from the rest of the packaging after the first opening.

This object is achieved by a closure as described and claimed herein. Advantageous embodiments of the present invention are also described.

BRIEF DESCRIPTION OF THE FIGURES

The features and advantages of the closure according to this invention will become apparent from the following description, given by way of non-limiting example in accordance with the figures in the accompanying drawings, in which:

With reference to FIG. 1, reference sign 1 indicates, as a whole, a thin-walled packaging comprising a flexible pouch 2, a spout 4 and a closure 6 applied to the spout 4 in order to close it.

With reference to FIGS. 2*a*, 2*b*, 2*c*, 3 and 4, the spout 4 has an inner spout channel 5 which extends along a spout axis X between an inner opening 7 configured to remain inside the pouch 2, and an opposite spout mouth 9 from which the product to be consumed comes out.

Figure 1:
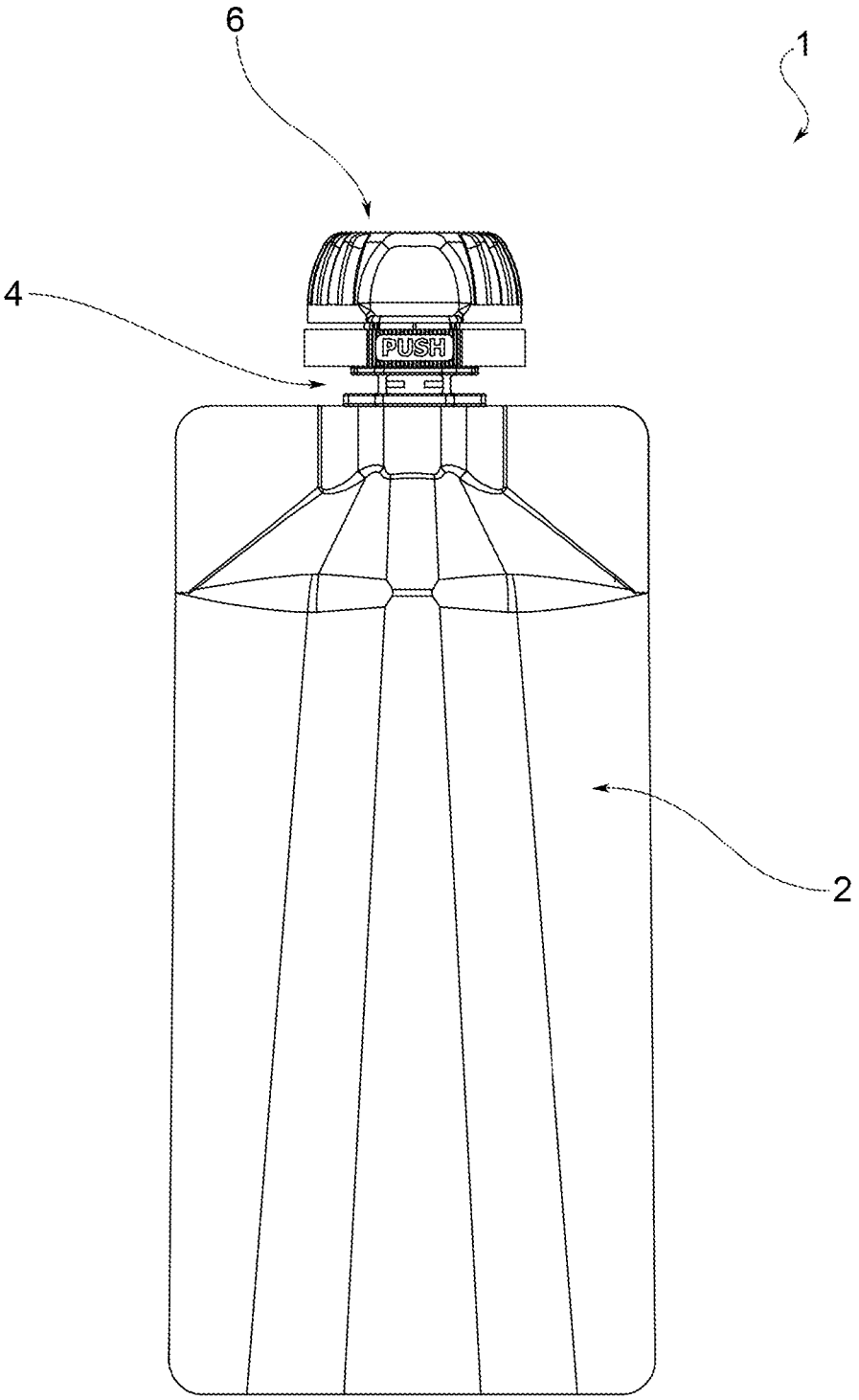
FIG. 1 shows a thin-walled packaging according to one embodiment of the present invention.
Figure 2A:
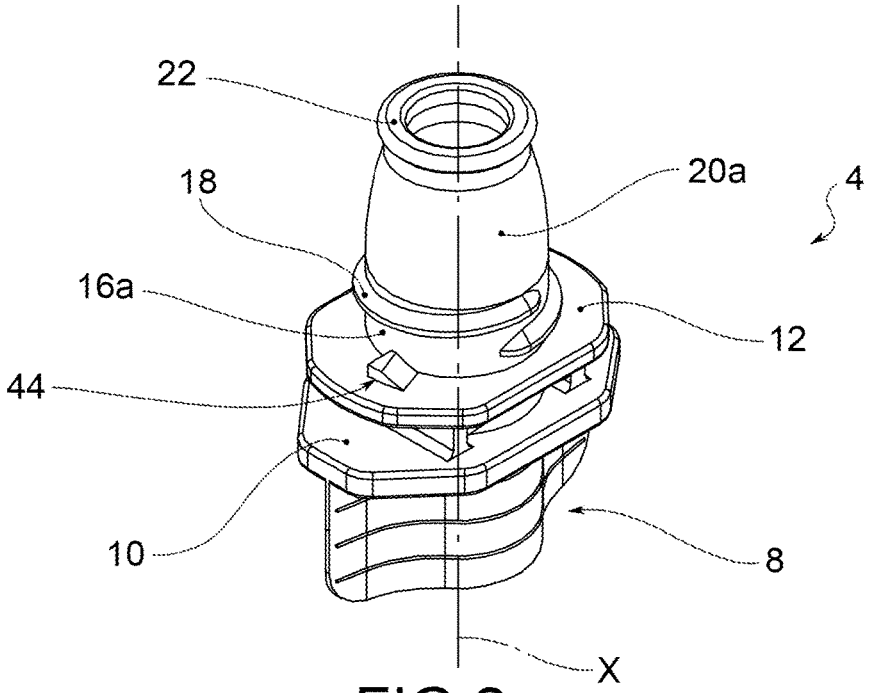
FIG. 2*a* shows a spout according to one embodiment of this invention.
Figure 2B:
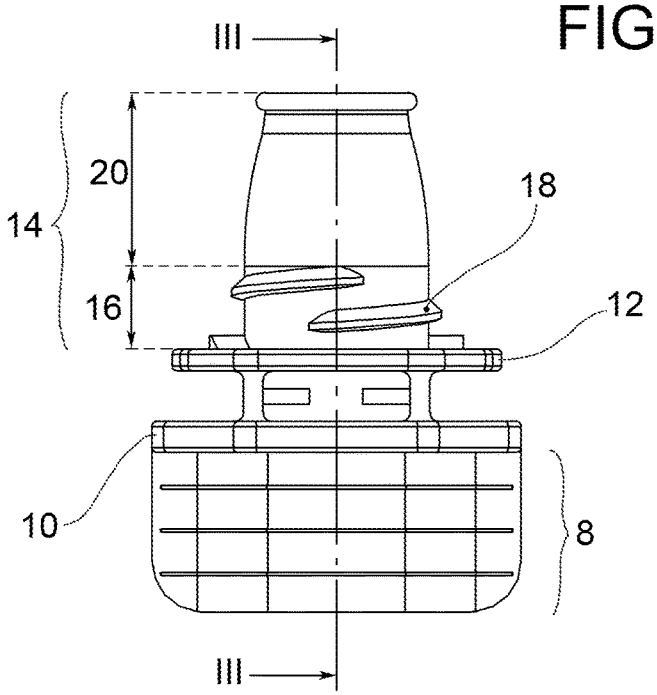
FIGS. 2*b* and 2*c* are a front view and a lateral view of the spout from FIG. 2*a*, respectively.
Figure 2C:
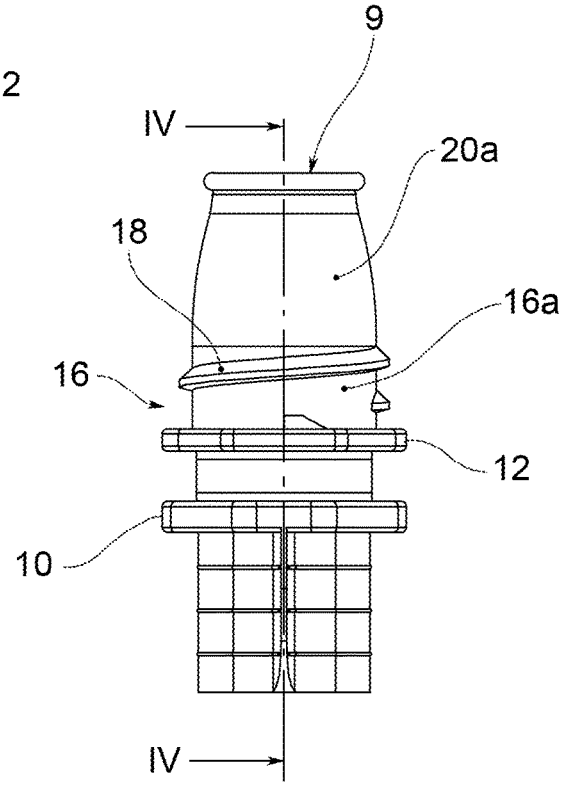
Figure 4:
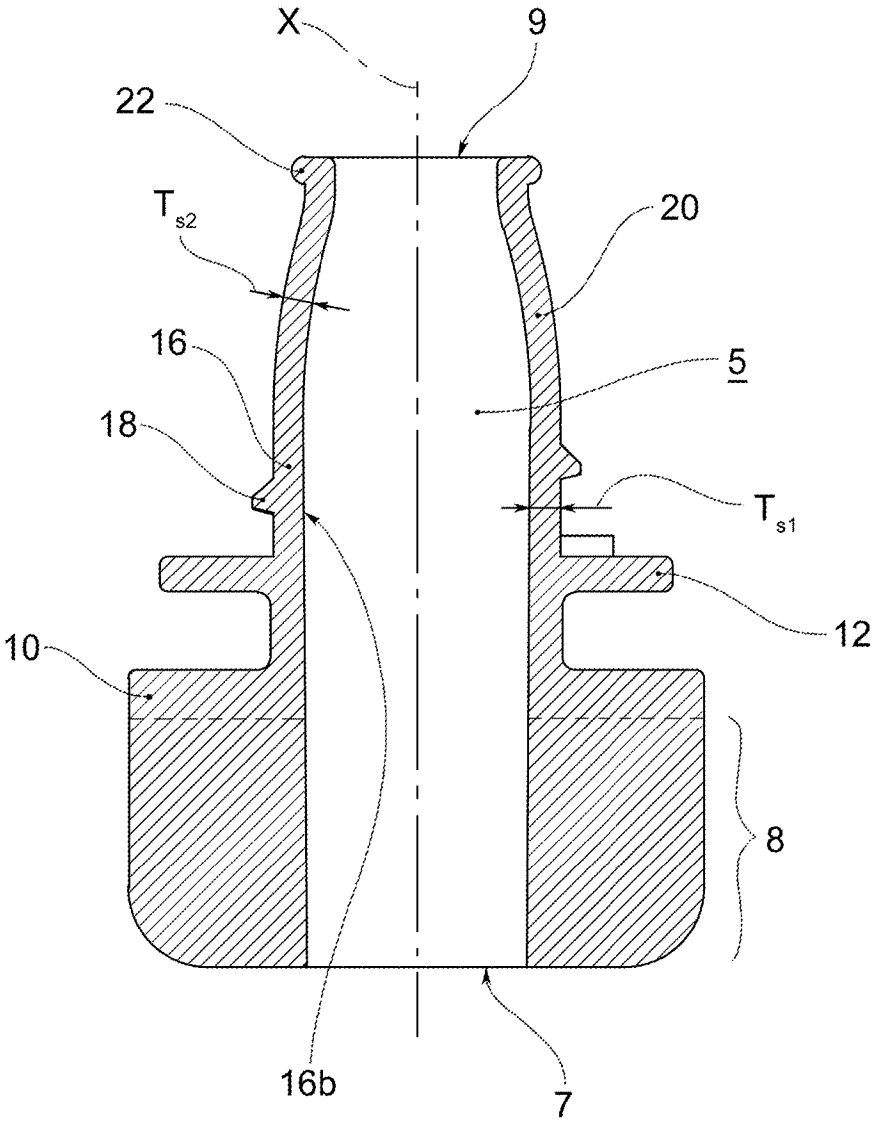
FIGS. 3 and 4 are a cross section of the spout from FIG. 2*a* along the sectional plane and a cross section of the spout from FIG. 2*b* along the sectional plane IV-IV, respectively.
Figure 3:
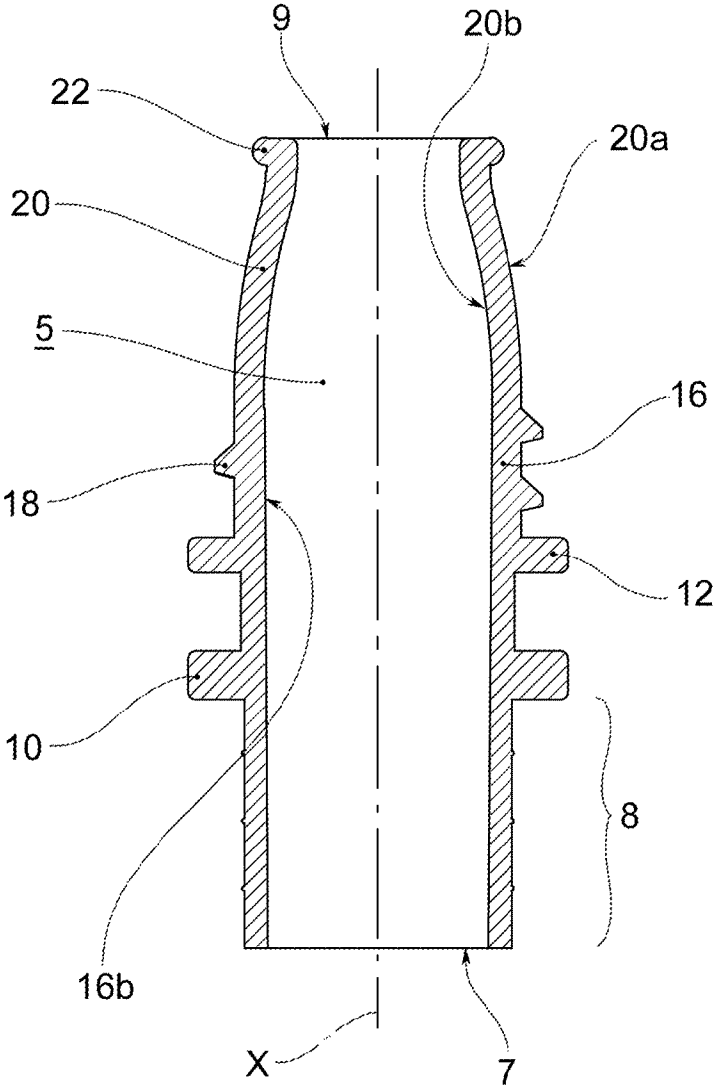

Externally, the spout 4 comprises a connecting portion 8, usually defined as a "welding boat," that is provided with the inner opening 7 and is intended to be sealingly applied between the flexible walls of the pouch 2, for example by means of welding. The connecting portion 8 ends with a first spout wall 10, orthogonal to the spout axis X.

The spout 4 also comprises a second spout wall 12 which is spaced apart from and parallel to the first spout wall 10, and a mouth portion 14 which extends from the second spout wall 12 up to the spout mouth 9.

The mouth portion 14 preferably comprises a first annular mouth wall 16 which extends for example from the second spout wall 12 and has a cylindrical outer lateral surface 16*a*, coaxial to the spout axis X, and a thread 18 for screwing the closure 6, which thread projects from the outer lateral surface 16*a*. The first mouth wall 16 preferably has a cylindrical inner lateral surface 16*b*, coaxial to the spout axis X. The outer lateral surface 16*a* and the inner lateral surface 16*b* define a thickness Ts1 of the first mouth wall 16.

The mouth portion 14 also comprises a second annular mouth wall 20 which extends from the first mouth wall 16 toward the mouth 9.

The second mouth wall 20 has a domed outer lateral surface 20*a*, i.e. which has a profile that is at least partially arcuate in cross section, so as to provide a tapered shape. The second mouth wall 20 preferably has a domed inner lateral surface 20*b* which follows the course of the outer lateral surface. The spout channel 5 therefore narrows from the inner opening 7 toward the mouth 9, in close proximity to the mouth 9. The outer lateral surface 20*a* and the inner lateral surface 20*b* define a thickness Ts2 of the second mouth wall 20. The thickness Ts2 is preferably constant over the entire second mouth wall 20.

Moreover, the thickness Ts1 of the first mouth wall 16 is preferably equal to the thickness Ts2 of the second mouth wall 20 (Ts1=Ts2); a thickness Ts for the mouth portion 14 that is equal to the thickness Ts1 of the first mouth wall 16 and to the thickness Ts2 of the second mouth wall 20 is thus defined (Ts=Ts1=Ts2).

Moreover, the spout 4 preferably comprises an annular rib 22 which delimits the mouth 9, has a thickness greater than the thickness Ts of the mouth portion 14, and projects with respect to the outer lateral surface 20*a* of the second mouth wall 20.

The closure 6, which is made in a single piece, for example by means of injection molding, from plastics material, is made separately from the spout 4 and may be applied thereto in an irremovable manner.

Figure 5A:
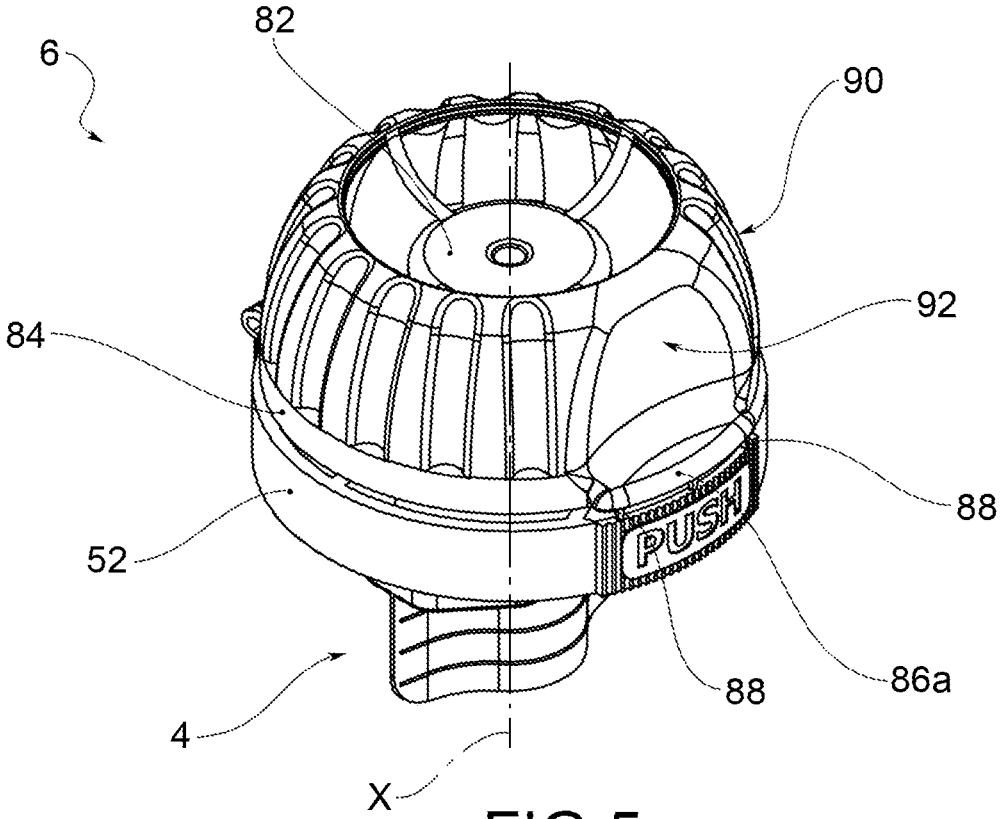
FIG. 5*a* shows a closure assembly according to one embodiment of this invention, in a closed or intact closed configuration.
Figure 5B:
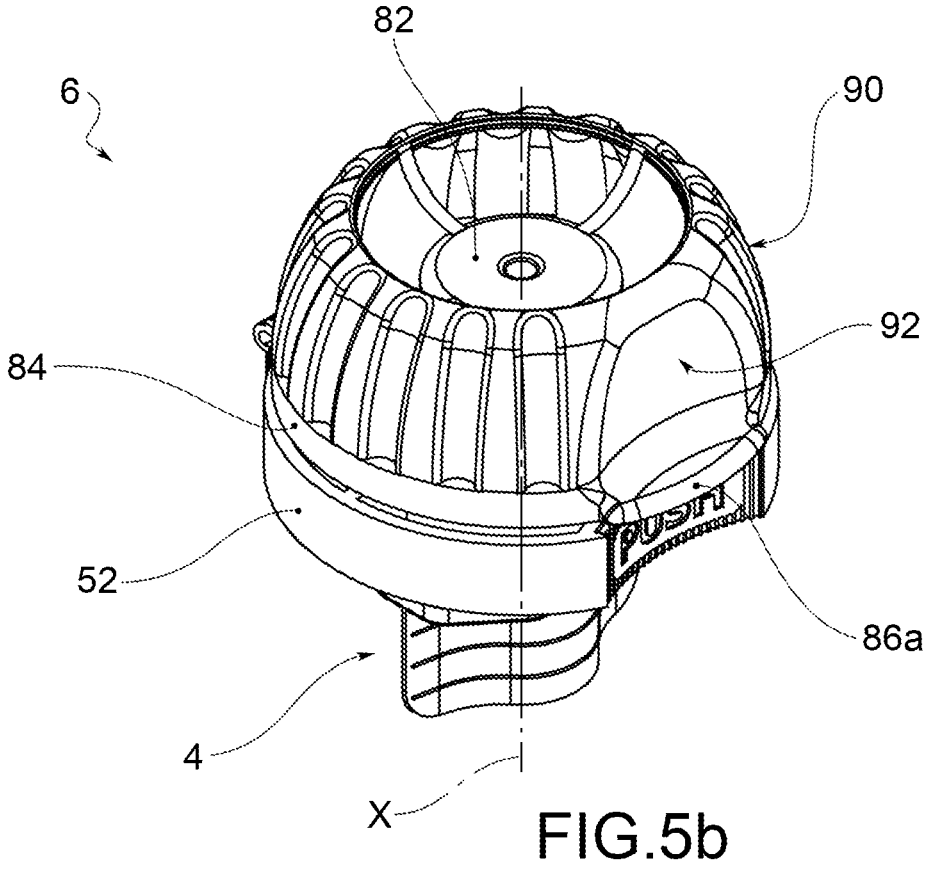
FIG. 5*b* shows the closure assembly in an intermediate open configuration.
Figure 5C:
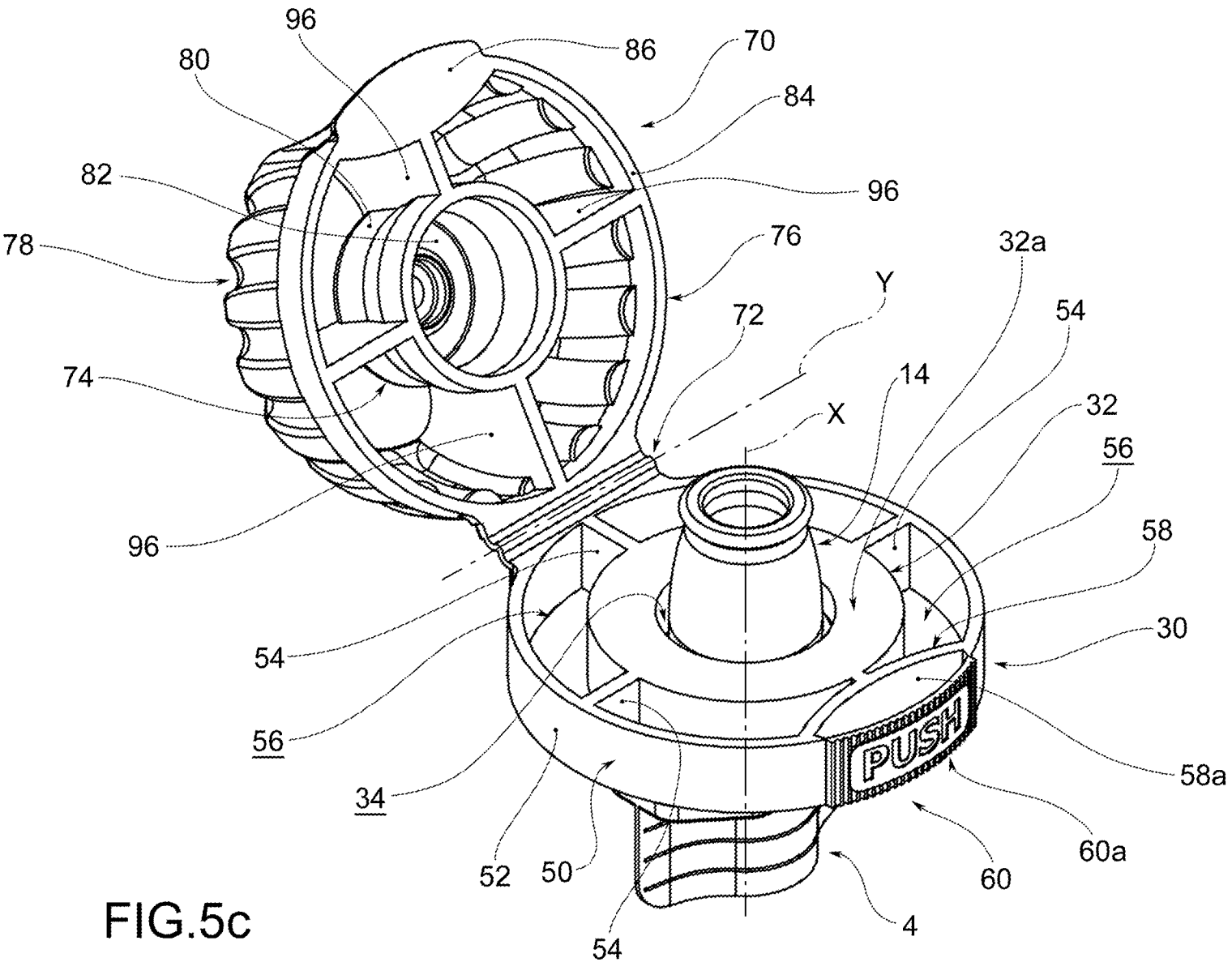
FIG. 5*c* shows the closure assembly in an open configuration.
Figure 6A:
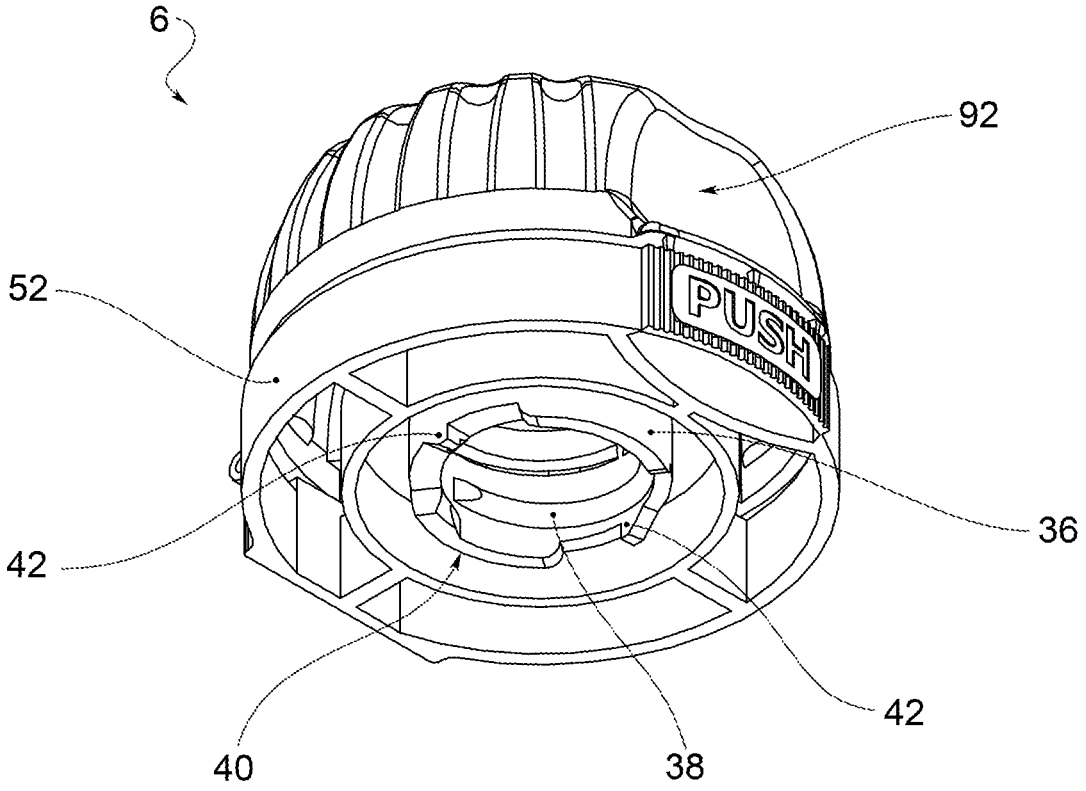
FIGS. 6*a* and 6*b* show a closure according to one embodiment of this invention.
Figure 6B:
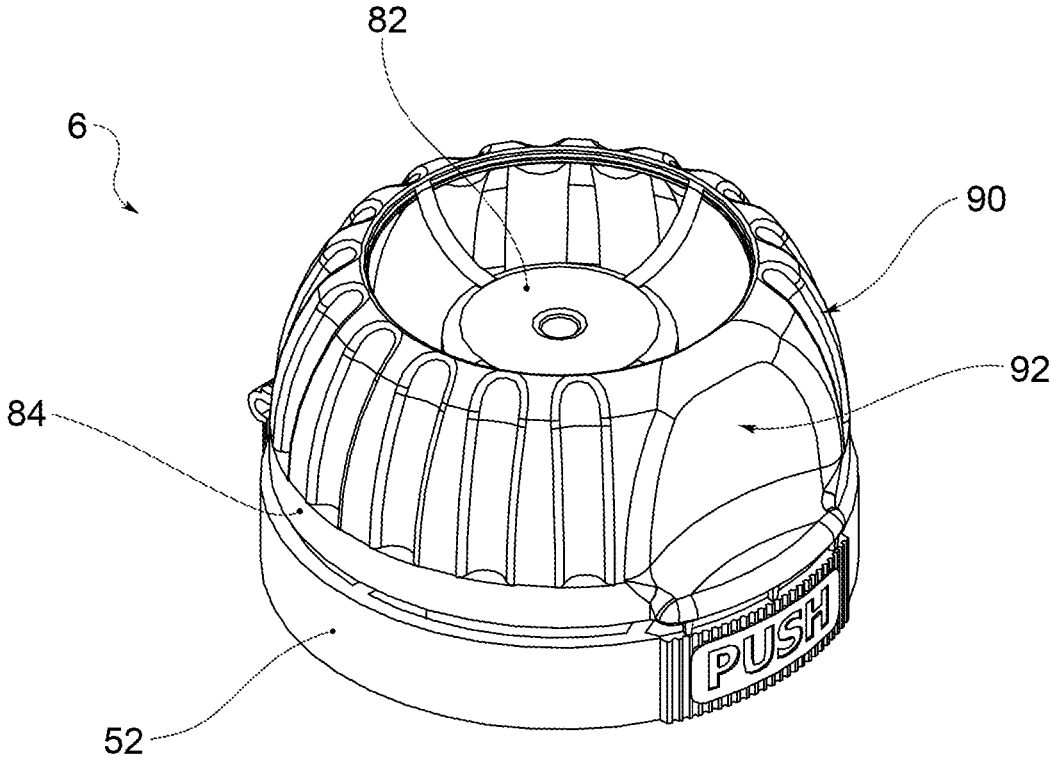

For this purpose, with reference to FIGS. 5*a*, 5*b*, 5*c*, 6*a* and 6*b*, the closure 6 comprises a base body 30 comprising an annular inner portion 32, for example in the form of a circular crown, that is provided with an axially extending base hole 34 through which the mouth portion 14 of the spout 4 passes; the base hole 34 is preferably coaxial to the spout axis X and the mouth portion 14 of the spout 4 projects axially beyond an upper face 32*a* of the inner portion 32.

The base hole 34 is annularly delimited by a hole wall 36 projecting axially on the opposite side to the upper face 32*a* of the inner portion 32. The hole wall 36 is internally provided with a threading 38 for screwing the closure 6 to the spout 4, and in particular to the threading 18 of the mouth portion 14.

The hole wall 36 axially ends with a wall edge 40 provided with at least one tooth 42 adapted to snap-fit engage a relevant projection 44 provided on the spout 4 in an irremovable manner (unless the structure is damaged).

In particular, said projections 44 of the spout 4 are located in the mouth portion 14, adjacent to the threading 18, for example projecting from the second spout wall 12.

The base body 30 of the closure 6 also comprises an outer portion 50 which, for example, radially externally surrounds the inner portion 32.

The outer portion 50 comprises a base band 52 that is spaced radially from the inner portion 32 and is connected thereto by a plurality of angularly spaced spokes 54, so as to create spaces 56 extending axially between the inner portion 32 and said base band 52.

The outer portion 50 also comprises an abutment wall 58 which is placed along the base band 52 and has a front face 58*a* which is concave outwards. The abutment wall 58 is preferably connected to the inner portion 32 by one of said spokes 54.

Moreover, the outer portion 50 comprises a guarantee wall 60 which is placed along the base band 52 at the abutment wall 58 and has an outer face 60*a* inscribed in an imaginary cylindrical surface that is convex outwards.

The guarantee wall 60 is irreversibly yielding—of course unless subjected to external actions—i.e. it maintains the deformed shape when it is deformed so as to abut against the front face 58*a* of the abutment wall 58 that is placed behind the guarantee wall 60. For example, said guarantee wall 60 is yielding by virtue of the outer face 60*a* having a saw-tooth shape created by a plurality of steps circumferentially placed side by side.

The closure 6 also comprises a cap assembly 70 and a flexible hinge 72 that connects the cap assembly 70 to the base body 30 such that the cap assembly 70 may be rotated in order to open and close the closure 6. For example, the hinge 72 connects the cap assembly 70 to the band 52 of the outer portion 50 and extends along a hinge axis Y lying on an imaginary plane orthogonal to the spout axis X and tangential to the band 52, so that the cap assembly 70 is rotatable with respect to said hinge axis Y.

The cap assembly 70 comprises a cap 74, a guarantee portion 76 and preferably a grip portion 78.

The cap 74 comprises an annular cap wall 80 and a cap base 82 which, in a closed configuration of the closure 6, closes the spout mouth 9 by adhering, for example, to the rib 22. The cap wall 80 has a central cap axis Z which, in a closed configuration of the closure 6, coincides with the spout axis X of the spout 4; in this configuration, the cap wall 80 surrounds the second mouth wall 20 of the mouth portion 14.

The guarantee portion 76 comprises an annular guarantee band 84 which extends radially externally to the cap 74 and which, in the closed configuration of the closure 6, is overlapped by and preferably axially spaced apart from the base band 52 of the base body 30.

The hinge 72 preferably connects the guarantee band 84 to the base band 52.

The guarantee band 84 comprises a guarantee tab 86 which, in the closed configuration of the closure 6, axially surmounts the guarantee wall 60 of the base body 30; moreover, the guarantee tab 86 is peripherally delimited by a strip edge 86*a* which, in the closed configuration, is positioned radially inside the imaginary cylindrical surface on which the outer face 60*a* of the guarantee wall 60 is inscribable.

Moreover, in an intact closed configuration, the guarantee tab 86 and the guarantee wall 60 are joined by at least one breakable bridge 88; when the closure 6 is first opened, when the guarantee wall 60 is pressed against the front face 58*a* of the abutment wall 58, the bridges 88 break and the cap assembly 70 may be rotated in order to open the closure 6.

The grip portion 78 surrounds the cap 74 and surmounts the guarantee band 84; said grip portion 78 preferably comprises a domed grip region 90 and a guarantee region 92 which forms a recess with respect to the outer surface of the grip region 90 and is placed at the guarantee tab 86.

The cap 74 is preferably connected to the guarantee band 84 and to the grip portion 78 by a plurality of angularly spaced cap spokes 96, so as to form cap spaces 98 between the cap 74 and the guarantee band 84 and the grip portion 78.

The base spaces 56 and the cap spaces 98 have an anti-suffocation function.

In the closed configuration (FIG. 5*a*), the cap assembly 70 surmounts the base body 30, and the cap 74 closes the spout mouth 9 of the spout 4; moreover, in the intact closed configuration, the guarantee band 84 of the cap assembly 70 is joined to the guarantee wall 60 of the base body 30 by the bridges 88, which are integral. Moreover, the strip edge 86*a* is positioned radially inside the imaginary cylindrical surface on which the outer face 60*a* of the guarantee wall 60 is inscribed.

In order to open the closure 6 (FIG. 5*b*), the guarantee wall 60 of the base body 30 is pressed, for example by a finger of the user, such that it abuts against the front face 58*a* of the abutment wall 58 and deforms permanently. The strip edge 86*a* is thus positioned at least in part radially externally to the deformed guarantee wall 60 and may be used as a contact against the finger of the user in order to raise the cap assembly 70 and break the bridges 88.

In the open configuration, the cap assembly 70 is rotated with respect to the position assumed in the closed configuration and the hinge 72 is configured to keep the cap assembly 70 sufficiently far away from the spout mouth 9, in order to allow the spout to be used comfortably.

In the intact closed configuration, the closure 6 is made in a single piece, for example by means of injection molding, from plastics material.

Innovatively, the closure according to this invention satisfies the above-mentioned requirements, in that it has a guarantee seal that shows that the closure is broken and, once the closure is open, the cap assembly remains connected to the base body which is in turn connected to the spout. It is therefore not possible to separate the cap assembly from the spout and from the pouch, so that all of the components of the packaging have to be disposed of together.

It is clear that a person skilled in the art, in order to satisfy current needs, could make modifications to the closure described above, which modifications are all contained within the scope of protection as defined in the following claims.

What is claimed is:

1. A closure for a spout of a flexible thin-walled packaging, comprising a base body irremovably screwable to the spout, comprising an irreversibly yielding guarantee wall;

a cap assembly comprising a cap and a guarantee tab which, in a closed configuration, axially surmounts the guarantee wall;

at least one breakable bridge which, in an intact closed configuration, is integral and joins the guarantee tab to the guarantee wall; and a flexible hinge that joins the base body to the cap assembly to rotate the cap assembly from the closed configuration to an open configuration in which the cap is disengaged from a spout mouth.

2. The closure of claim 1, wherein the base body is provided with a base hole for insertion of a mouth portion of the spout, said base hole being annularly delimited by a hole wall internally provided with a threading for screwing the closure to the spout.

3. The closure of claim 2, wherein the hole wall axially ends with a wall edge provided with at least one tooth adapted to snap-fit engage a relevant projection of the spout in an irremovable manner.

4. The closure of claim 1, wherein the base body comprises an abutment wall having a front face that is concave outwards, said guarantee wall being placed at the abutment wall, radially outside the abutment wall.

5. The closure of claim 1, wherein the guarantee wall has an outer face with a saw-tooth shape created by a plurality of steps circumferentially placed side by side which provide irreversible yielding.

6. The closure of claim 1, wherein the flexible hinge extends along a hinge axis lying on an imaginary plane orthogonal to a cap axis in the closed configuration, so that the cap assembly is rotatable with respect to said hinge axis.

7. The closure of claim 1, wherein the guarantee tab is peripherally delimited by a strip edge which, in the closed configuration, is positioned radially inside an imaginary cylindrical surface on which an outer face of the guarantee wall is inscribable.

8. The closure of claim 1, wherein the cap assembly further comprises a grip portion that surrounds the cap and comprises a grip region and a guarantee region that forms a recess with respect to an outer surface of the grip region, said guarantee region being placed at the guarantee tab.

9. A closure assembly comprising:

a spout provided with a mouth portion comprising a first mouth wall externally having a threading and a second mouth wall having an outer lateral surface devoid of projections; and a closure for a spout of a flexible thin-walled packaging, comprising a base body irremovably screwable to the spout, comprising an irreversibly yielding guarantee wall;

a cap assembly comprising a cap and a guarantee tab which, in a closed configuration, axially surmounts the guarantee wall;

at least one breakable bridge which, in an intact closed configuration, is integral and joins the guarantee tab to the guarantee wall; and a flexible hinge that joins the base body to the cap assembly to rotate the cap assembly from the closed configuration to an open configuration in which the cap is disengaged from a spout mouth, wherein the base body is irreversibly screwed to the first mouth wall and the second mouth wall passes through the base body and projects axially therefrom.

10. The closure assembly of claim 9, wherein the spout comprises at least one projection for snap-fit engaging the base body of the closure in an irremovable manner.

* * * * *